US007267839B2

(12) United States Patent
Tanaka et al.

(10) Patent No.: US 7,267,839 B2
(45) Date of Patent: Sep. 11, 2007

(54) METHOD OF AND APPARATUS FOR APPLYING LIQUID MATERIAL

(75) Inventors: Koji Tanaka, Tokyo (JP); Hitoshi Nakayama, Tokyo (JP); Shinji Atsuzawa, Tokyo (JP); Youichi Andoh, Tokyo (JP)

(73) Assignee: TDK Corporation, Tokyo (JP)

( * ) Notice: Subject to any disclaimer, the term of this patent is extended or adjusted under 35 U.S.C. 154(b) by 440 days.

(21) Appl. No.: 10/921,869

(22) Filed: Aug. 20, 2004

(65) Prior Publication Data

US 2005/0045653 A1 Mar. 3, 2005

(30) Foreign Application Priority Data

Aug. 26, 2003 (JP) ..... 2003-208772

(51) Int. Cl.
*B05D 1/26* (2006.01)

(52) U.S. Cl. ..... 427/8; 427/284; 427/96.1; 427/98.4

(58) Field of Classification Search ..... 427/8, 427/284, 96.1, 98.4
See application file for complete search history.

(56) References Cited

U.S. PATENT DOCUMENTS

2005/0235913 A1* 10/2005 Prentice et al. ..... 118/712

FOREIGN PATENT DOCUMENTS

| | | |
|---|---|---|
| JP | 9-099268 | 4/1997 |
| JP | 40-9325153 | * 12/1997 |
| JP | 11-051946 | * 2/1999 |
| JP | 2000-317373 | 11/2000 |
| JP | 2001-087693 | 4/2001 |
| JP | 2001-291999 | 10/2001 |
| JP | 2003-001165 | 1/2003 |

* cited by examiner

*Primary Examiner*—Fred J. Parker
(74) *Attorney, Agent, or Firm*—Oblon, Spivak, McClelland, Maier & Neustadt, P.C.

(57) ABSTRACT

Disclosed is a method, in which when a liquid material is applied to the application surface of an object of application by using a liquid material supply device having a syringe containing the liquid material and equipped with a needle having at its distal end an ejection hole from which the liquid material is ejected, an image of the distal end of the needle is taken laterally by a horizontal camera together with a height reference mark when an ascent/descent drive system of the liquid material supply device is set to a reference height, and the height position of the distal end of the needle is obtained from the difference between the height of the distal end of the needle and the height of the height reference mark.

6 Claims, 3 Drawing Sheets

METHOD OF AND APPARATUS FOR APPLYING LIQUID MATERIAL

BACKGROUND OF THE INVENTION

1. Field of the Invention

The present invention relates to a method and apparatus for applying a liquid material, such as adhesive, to an object of application through ejection, and more particularly to a method and apparatus for controlling the distance between and the positions of the object of application and a liquid material ejection hole with high accuracy (on the order of 10μ).

2. Related Background Art

Conventionally, in replacing the liquid material, the lower end (distal end) of a needle (application nozzle) mounted to a syringe filled with a liquid material is caused to abut a reference plate to effect positioning in the Z-direction (syringe axis direction), and the syringe and the needle are fixed to the ascent/descent drive system of an apparatus. That is, the reference plate surface constitutes the positional reference for the distal end of the needle.

It is to be noted that a needle having a small diameter will be deflected when caused to abut the reference plate and will be restored to the former state when separated from the reference plate and there is no load (that is, when the needle is in the air). As a result, with such a needle, positional deviation of the distal end of the needle in the X-, Y-, and Z-directions is involved.

Examples of the techniques regarding liquid material application are disclosed in the following publications: Japanese Patent Application Laid-Open No. 2003-1165, Japanese Patent Application Laid-Open No. 2000-317373, Japanese Patent Application Laid-Open No. 2001-87693, Japanese Patent Application Laid-Open No. 9-99268, and Japanese Patent Application Laid-Open No. 2001-291999.

Japanese Patent Application Laid-Open No. 2003-1165 discloses a construction in which an abutment terminal provided on the syringe side is caused to abut the object of application, thereby maintaining a fixed distance between the liquid material ejection hole and the reference plate.

However, since the distance between the liquid material ejection hole and the reference plate is determined by the dimensional accuracy (parts accuracy) of the abutment terminal, the syringe, and the needle with the liquid material ejection hole, the construction is not suitable for an apparatus in which it is necessary to control the distance between the liquid material ejection hole and the reference plate on the order of microns.

Japanese Patent Application Laid-Open No. 2000-317373, Japanese Patent Application Laid-Open No. 2001-87693, Japanese Patent Application Laid-Open No. 9-99268, and Japanese Patent Application Laid-Open No. 2001-291999 disclose a construction in which, in applying liquid material, the distance between the reference plate and the distal end of the needle is measured by a non-contact distance sensor.

It is to be noted, however, that the non-contact distance sensor is mounted to the syringe and a needle holding member, and the distance between the distal end of the needle and the reference plate is measured on the assumption that the distal end of the needle is always at the same position. Thus, if the position of the distal end of the needle (in the Z-direction) at the time of replacement differs from that at the time of application (when there is no load), no correction (detection) of this difference is possible.

Further, in the case of an apparatus for performing wire bonding or liquid application between IC lead terminals or to a narrow range such as IC underfill, or a high-density place, a high level of accuracy in the X-, Y-, and Z-directions of the liquid material ejection hole is required, and the distance between the ejection hole and the application surface, or the dimension for avoiding interference with the component, has to be controlled on the order of 10 microns. As a result, measures must also be taken against needle bending.

SUMMARY OF THE INVENTION

In view of the above problems, it is an object of the present invention to provide a method and apparatus for applying a liquid material, in which it is possible to eject a liquid material with high accuracy toward an object of application without being affected by misalignment, bending, and deflection of the needle generated at the time of replacement of the liquid material supply means including the syringe and needle, or as a result of repeated use of the needle.

To attain the above object, according to one aspect of the present invention, there is provided a liquid material applying method, including: using a liquid material supply means having a syringe containing the liquid material and equipped with a needle having at its distal end an ejection hole from which the liquid material is ejected; and applying a liquid material to an application surface of an object of application, the method comprising steps of taking an image of the distal end of the needle laterally by an image taking means together with a height reference mark when an ascent/descent drive system of the liquid material supply means is set to a reference height; and obtaining a height position of the distal end of the needle from a difference between the height of the distal end of the needle and a height of the height reference mark.

According to another aspect of the present invention, there is provided a liquid material applying method, including: using a liquid material supply means having a syringe containing the liquid material and equipped with a needle having at its distal end an ejection hole from which the liquid material is ejected; and applying a liquid material to an application surface of an object of application, the method comprising steps of using a pressure sensor having a sensor surface whose height is a known value; lowering the liquid material supply means by an ascent/descent drive system to bring the distal end of the needle into contact with the sensor surface; and detecting a height position of the distal end of the needle by using a height of the sensor surface as a reference at the time of pressure detection by the pressure sensor.

According to further aspect of the present invention, the liquid material applying method described above further includes: measuring a height of the application surface by a height measuring means; and controlling the height of the liquid material supply means at the time of liquid material application based on a measurement value thereby obtained.

According to still further aspect of the present invention, there is provided a liquid material applying method, including: using a liquid material supply means having a syringe containing the liquid material and equipped with a needle having at its distal end an ejection hole from which the liquid material is ejected; and applying a liquid material to an application surface of an object of application, the method comprising steps of comparing a needle side surface reference image of a needle free from bending with a needle side surface image taken laterally by an image taking means in one of a state at the start of use of the needle and a state after repeated use thereof; and determining that there is abnormality in needle bending when a deviation amount between the needle side surface reference image and the needle side surface image thus taken exceeds a predetermined value.

According to still further aspect of the present invention, the liquid material applying method described above further includes imaging the needle continuously or intermittently while rotating the needle at least by 90 degrees to thereby obtain the needle side surface image.

According to still further aspect of the present invention, there is provided a liquid material applying method, including: using a liquid material supply means having a syringe containing the liquid material and equipped with a needle having at its distal end an ejection hole from which the liquid material is ejected; and applying a liquid material to an application surface of an object of application, the method comprising steps of determining that there is abnormality in needle bending at one of a time when a needle distal end surface cannot be recognized in a first needle bottom surface image taken by an image taking means from a bottom surface direction in an initial state of the needle, and a time when a deviation amount between information on a center of the needle distal end surface in the first needle bottom surface image and pre-set information on the center of the needle distal end surface exceeds a predetermined value.

According to still further aspect of the present invention, there is provided a liquid material applying method, including: using a liquid material supply means having a syringe containing the liquid material and equipped with a needle having at its distal end an ejection hole from which the liquid material is ejected; and applying a liquid material to an application surface of an object of application, the method comprising steps of and determining that there is abnormality in needle bending at one of a time when a needle distal end surface cannot be recognized in a second needle bottom surface image taken by an image taking means from a bottom surface direction after repeated use of the needle, and a time when a deviation amount between information on a center of the needle distal end surface in the second needle bottom surface image and pre-set information on the center of the needle distal end surface exceeds a predetermined value.

According to still further aspect of the present invention, there is provided a liquid material applying apparatus, including: a liquid material supply means having a syringe containing a liquid material and equipped with a needle having at its distal end an ejection hole from which the liquid material is ejected to be applied to an application surface of an object of application; an ascent/descent drive system for the liquid material supply means; a height reference mark; and an image taking means for image-taking the height reference mark laterally, wherein an image of the distal end of the needle is taken by the image taking means together with the height reference mark when the ascent/descent drive system is set to a reference height, and wherein a height position of the distal end of the needle is obtained from a difference between the height of the distal end of the needle and a height of the height reference mark.

According to still further aspect of the present invention, there is provided a liquid material applying apparatus, including: a liquid material supply means having a syringe containing a liquid material and equipped with a needle having at its distal end an ejection hole from which the liquid material is ejected to be applied to an application surface of an object of application; an ascent/descent drive system for the liquid material supply means; and a pressure sensor having a sensor surface whose height is a known value, wherein the liquid material supply means is lowered by the ascent/descent drive system to bring the distal end of the needle into contact with the sensor surface, and wherein a height position of the distal end of the needle is detected by using a height of the sensor surface as a reference at the time of pressure detection by the pressure sensor.

According to still further aspect of the present invention, the liquid material applying apparatus described above further includes a height measuring means for measuring a height of the application surface, and a height of the liquid material supply means at a time of liquid material application is controlled based on a measurement value obtained by the height measuring means.

According to still further aspect of the present invention, in the liquid material applying apparatus described above, the height measuring means includes a linear sensor that comes into contact with the application surface for measurement.

Other objects and features of the present invention will become apparent from the following description of embodiments.

DESCRIPTION OF THE PREFERRED EMBODIMENTS

Embodiments of the method of and the apparatus for applying liquid material of the present invention will be described with reference to the drawings.

The method of and the apparatus for applying liquid material of the present invention is intended, in particular, for performing wire bonding or liquid application between IC lead terminals or to a narrow range such as IC underfill, or a high-density place, so that a high level of accuracy in the X-, Y-, and Z-directions of the liquid material ejection hole at the lower end (distal end) of the needle is required. Incidentally, the distance between the ejection hole and the application surface such as a substrate or the dimension for avoiding interference with the component has to be controlled on the order of 10 microns.

Figure 1A:
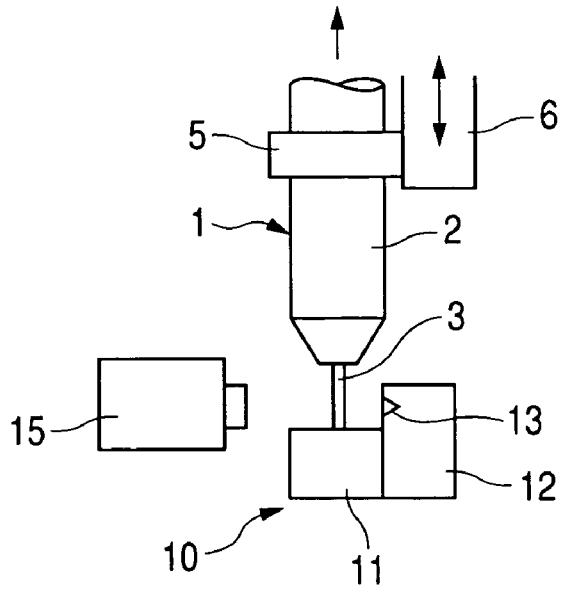
FIGS. 1A through 1C are schematic diagrams showing the construction of a first embodiment of the present invention.
Figure 1B:
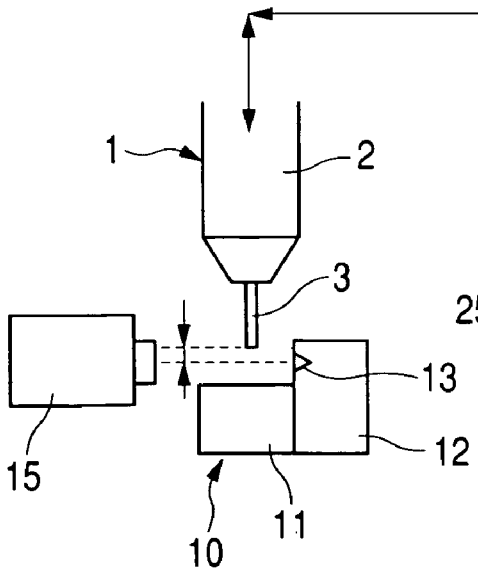
Figure 1C:
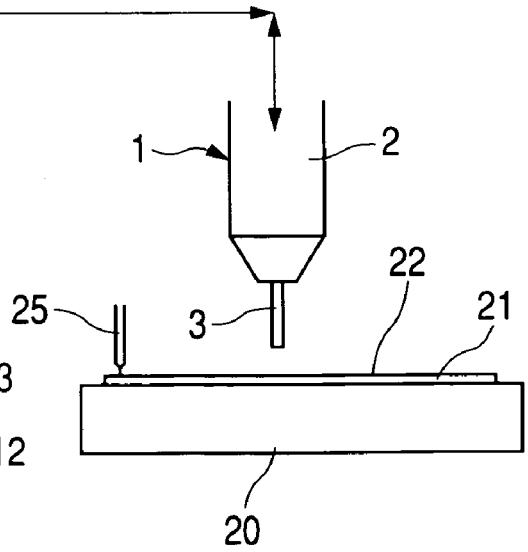

FIGS. 1A through 1C show a method of and an apparatus for applying liquid material according to the first embodiment of the present invention, illustrating a construction for controlling with high accuracy the distance between the liquid material ejection hole at the lower end of the needle and the application surface of the object of application. In the drawing, numeral 1 indicates a liquid material supply means, which is composed of a syringe 2 containing a liquid material to be applied, such as adhesive, and a needle (application nozzle) 3 connected to the lower end of the syringe, with the needle 3 communicating with the interior of the syringe and the lower end (distal end) of the needle constituting the ejection hole. By the action of the syringe 2, a predetermined amount of liquid material is ejected from the ejection hole at the lower end of the needle.

The syringe 2 portion of the liquid material supply means 1 is held by a holding means 5, which is fixed to a drive system 6 having at least a Z-axis direction moving function (ascent/descent function). In order that the liquid material supply means 1 may allow replacement, the holding means 5 has a function by which it can cancel the holding of the syringe portion and a function by which it fixedly holds the syringe portion.

FIGS. 1A and 1B show a replacement station used when replacing the liquid material supply means 1; the replacement station is equipped with a replacement table (needle set reference plate) 11 and a replacement stage 10 having an upright mark member 12 fixedly provided by the side thereof. A height reference mark 13 is provided on a side surface of the mark member 12. Further, a horizontal camera 15 as a horizontal image taking means (arranged in a horizontal plane, i.e., an XY-plane) which has the height reference mark 12 in its field of view is fixedly supported in the vicinity of the replacement stage 10.

FIG. 1C shows an application station, which has a placement table 20, on which a substrate 21 constituting the object of application is fixedly placed. The upper surface of the substrate 21 constitutes an application surface 22, and there is provided a linear sensor 25 serving as a height measuring means for measuring the height of the application surface 22. The linear sensor 25 comes into contact with the application surface 22 to perform height measurement at a plurality of positions (preferably the application point or the vicinity thereof, etc.). As stated above, the distance between the ejection hole at the lower end of the needle and the application surface 22 of the substrate 21 requires a control on the order of 10 microns; for this purpose, there is provided the contact type linear sensor 25 for detecting any distortion, such as minute warpage, of the substrate 21.

When components are closely arranged on the substrate, and there is no gap that allows entrance of the contact terminal of the contact type linear sensor, it is possible to use a non-contact type sensor; however, since the reflectance differs when the object of measurement differs, there may be cases in which high accuracy information cannot be obtained. A contact type linear sensor is advantageous in that its accuracy does not depend on the object of measurement.

When the substrate 21 is so flat that distortion of the application surface 22 is negligible, it is possible to omit the linear sensor 25 and to treat the application surface 22 as a plane having a fixed, known height (which can be obtained since the height of the placement table 21 is known, and the thickness of the substrate 20 is a known amount).

The drive system 6 of the liquid material supply means 1 may be endowed with a movement function in the X-axis direction in a horizontal plane and in the Y-axis direction perpendicular thereto; when the replacement stage 10 and the placement table 20 are mounted on an XY table and endowed with a movement function in the X- and Y-axis directions, it is also possible for the drive system 6 to be endowed with an ascent/descent function solely in the Z-axis direction.

Next, the operation of replacing the liquid material supply means and the liquid applying operation after the replacement in the first embodiment shown in FIGS. 1A through 1C will be described.

In performing the operation of replacing the liquid material supply means 1 (the syringe 2 and the needle 3), the liquid material supply means 1 is moved to a position above the replacement table 11 of the replacement stage 10, and the liquid material supply means 1 that has been used up is removed from the holding means 5; then, the holding means 5 for the liquid material supply means 1 is moved to a previously set position (height), and a new liquid material supply means 1 filled with liquid material is manually mounted as shown in FIG. 1A. At this time, the mounting operation is conducted, with the lower end of the needle 3 abutting the upper surface of the replacement table 11. While the height of the upper surface of the replacement table 11 is a known amount, a needle 3 with a small diameter would undergo deflection when caused to abut the replacement table 11 and would be restored to the former state when detached from the replacement table 11 to be placed in a no-load condition (i.e., when the needle 3 is in the air), resulting in a positional deviation of the distal end of the needle in the X-, Y-, and Z-directions.

In view of this, in order to accurately detect the position of the lower end of the needle 3 after the replacement of the liquid material supply means 1 with a new one, the liquid material supply means 1 is raised in the Z-axis direction as shown in FIG. 1B, and the drive system 6 (having a movement function in the Z-axis direction) is set to a reference height; then the lower end of the needle 3 at this time is imaged by the horizontal camera 15 together with the height reference mark 13, and the difference between the height position of the lower end of needle and the height of the height reference mark 13 is calculated (through a computation processing); from this difference in height, the height position of the lower end of the needle is obtained, and the relationship between the height of the ascent/descent drive system 6 and the height position of the lower end of the needle 3 is accurately obtained (the positions of the height reference mark 13 and the lower end of the needle are processed through image recognition, and their relationship is stored as the position of the lower end of the needle when the drive system 6 is set to the reference height).

And, the liquid material supply means 1 moves to a position above the application station of FIG. 1C, and a liquid material, such as adhesive, is applied from the liquid ejection hole at the lower end of the needle 3 to the application surface 22 (upper surface) of the substrate 21 constituting the object of application on the placement table 20. At this time, the relationship between the height position of the ejection hole at the lower end of the needle 3 and the height position of the drive system 6 is accurately known, and the height of the application surface 22 has been accurately measured at a plurality of positions (e.g., the application point) by the contact type linear sensor 25, so that, at the application point determined by the positional information in the XY-plane previously obtained, it is possible to control the distance between the ejection hole at the lower end of the needle 3 and the application surface 22 as a known amount, applying the liquid material while maintaining the distance, for example, approximately 10 microns.

The first embodiment provides the following advantages:

(1) The lower end of the needle 3 when the drive system 6 for the liquid material supply means 1 is set to a reference height is horizontally imaged together with the height reference mark 13 by the horizontal camera 15 serving as the image taking means, and, from the difference between the height position of the lower end of the needle and the height of the height reference mark 13, it is possible to accurately obtain the height position of the lower end of the needle and, by extension, the relationship between the height of the drive system 6 and the height of the lower end of the needle. This proves effective, in particular, when the diameter of the needle 3 is small, and the influence of its deflection is not negligible.

(2) As the height measuring means for measuring the height of the application surface 22 of the object of application, the linear sensor 25 is used, which performs measurement while in contact with the application surface, whereby it is possible to accurately measure the height of the application point, etc., and to correct and control the height of the liquid material supply means 1 at the time of application of the liquid material based on the measurement value.

(3) Due to the above advantages (1) and (2), it is possible to accurately control the distance between the ejection hole at the lower end of the needle 3 and the application surface 22 as a known amount at the application point determined by the positional information in the XY-plane, making it possible to apply the liquid material while maintaining the distance at, for example, approximately 10 microns.

Figure 2A:
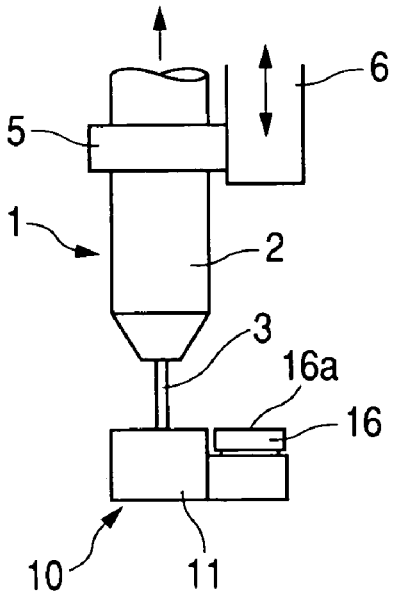
FIGS. 2A and 2B are schematic diagrams showing the construction of a second embodiment of the present invention.
Figure 2B:
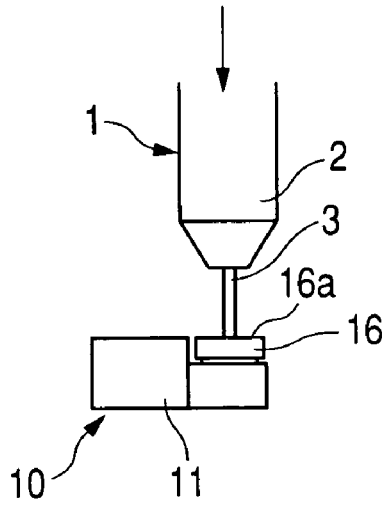

FIGS. 2A and 2B show a method of and an apparatus for applying liquid material according to the second embodiment of the present invention, illustrating a construction for controlling with high accuracy the distance between the ejection hole at the lower end of the needle and the application surface of the object of application. Here, FIGS. 2A and 2B show a replacement station for replacing the liquid material supply means 1, and the replacement station is equipped with the replacement stage 10 having the replacement table (needle set reference plate) 11 and a pressure sensor (contact sensor) 16 fixedly arranged adjacent thereto. The height of the sensor surface 16*a* of the pressure sensor 16 is a known value.

In this case, in performing the operation of replacing the liquid material supply means 1 (the syringe 2 and the needle 3), the liquid material supply means 1 is moved to a position above the replacement table 11 of the replacement stage 10, and the liquid material supply means 1 that has been used up is removed from the holding means 5; then, the holding means 5 for the liquid material supply means 1 is moved to a previously set position (height), and a new liquid material supply means 1 filled with liquid material is manually mounted as shown in FIG. 2A. At this time, the mounting operation is conducted, with the lower end of the needle 3 abutting the upper surface of the replacement table 11. While the height of the upper surface of the replacement table 11 is a known amount, a needle 3 with a small diameter would undergo deflection when caused to abut the replacement table 11 and would be restored to the former state when detached from the replacement table 11 to be placed in a no-load condition (i.e., when in the air), resulting in a positional deviation of the distal end of the needle in the X-, Y-, and Z-directions.

In view of this, after the replacement of the liquid material supply means 1 with a new one, in order to accurately detect the position of the lower end of the needle 3, the new liquid material supply means 1 is raised in the Z-axis direction to a position where the lower end of the needle is not in contact with the replacement table 11 to remove the deflection of the needle 3, and then the liquid material supply means 1 is lowered until the lower end of the needle 3 comes into contact with the sensor surface 16*a* of the pressure sensor 16 as shown in FIG. 2B, the contact position (at which the sensor detects pressure and a sensor signal is turned ON) being stored as the needle lower end position. That is, when the pressure sensor 16 detects pressure, it is possible to detect the height position of the needle lower end by using the height of the sensor surface 16*a* as a reference; the height of the sensor surface 16*a* is a known amount, and the pressure detecting operation is effected when the sensor surface is pressed by a minute amount; since this minute amount can also be a known amount, it is possible to accurately obtain the relationship between the height of the needle lower end at the time of pressure detection by the sensor and the height of the drive system 6 at this time.

Thus, in the second embodiment also, it is possible to accurately control the distance between the ejection hole at the lower end of the needle 3 and the application surface 22 as a known amount at the application point determined by the positional information in the XY-plane, making it possible to apply the liquid material while maintaining the distance at, for example, approximately 10 microns.

It should be noted that when the liquid material supply means 1 is replaced, with the needle 3 abutting the pressure sensor 16, a load is applied to the pressure sensor 16, which may affect the detection accuracy; thus, the replacement table 11 and the pressure sensor 16 are arranged so as to be at different position.

Otherwise, the construction and operation of the second embodiment are the same as those of the first embodiment, and the components that are the same as or equivalent to those of the first embodiment are indicated by the same reference numerals, with a description thereof being omitted.

Figure 3:
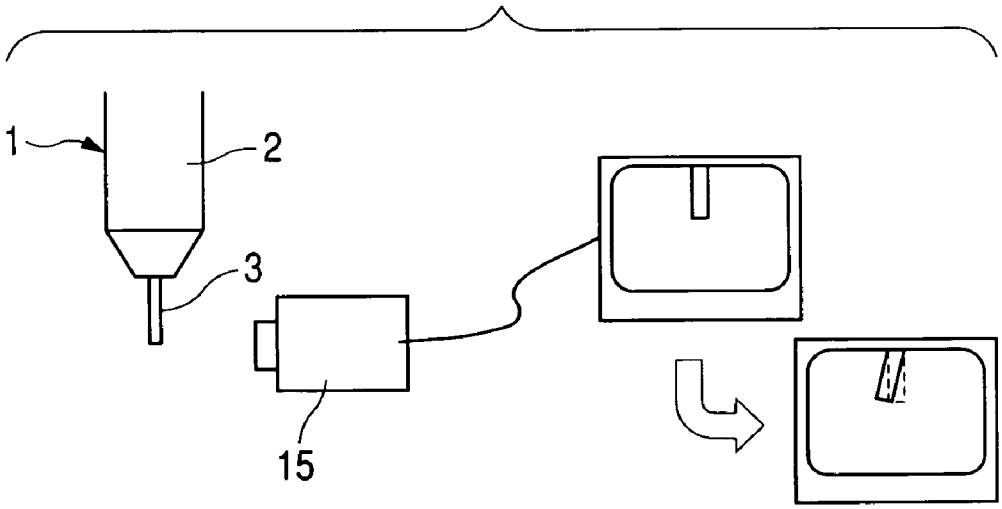
FIG. 3 is a schematic diagram showing the construction of a third embodiment of the present invention.

FIG. 3 shows a method of applying liquid material according to the third embodiment of the present invention, in which there is conducted needle bending detection through image comparison for controlling the application position with high accuracy. In this case, the side surface configuration of the needle 3 that is not bent is previously imaged by the horizontal camera 15 (arranged in a horizontal plane, that is, an XY-plane) serving as the image taking means and subjected to image processing; the information on the needle configuration thus obtained (needle side surface reference image) is compared with information on the needle configuration imaged by the horizontal camera 15 after setting the liquid material supply means 1 with the syringe 2 and the needle 3 and subjected to image processing (needle side surface image taken when there is no load); when the deviation amount between the two images is not less than a certain value, it is determined that there is abnormality in needle bending, and use of the needle is prohibited. The image taking is conducted while rotating the needle 3 by 90 to 360 degrees around its axis.

Immediately after the setting of the liquid material supply means 1, even if there is no abnormality in needle bending, there is the possibility of needle bending being generated with passage of time (as it is repeatedly used). For this reason, also after repeated use of the needle 3, the needle side surface is imaged by the horizontal camera 15 and subjected to image processing; the information on the needle configuration thus obtained (the needle side surface image taken at the time of repeated use thereof) is compared with the above-mentioned needle side surface reference image; when the deviation amount between the two images is not less than a certain value, it is determined that there is abnormality in needle bending, and use of the needle is prohibited.

In this third embodiment, use of an excessively bent needle 3 is prohibited beforehand, whereby, when applying liquid material to the application surface of an object of application, it is possible to achieve an improvement in terms of accuracy in application position in the X- and Y-directions.

Figure 4:
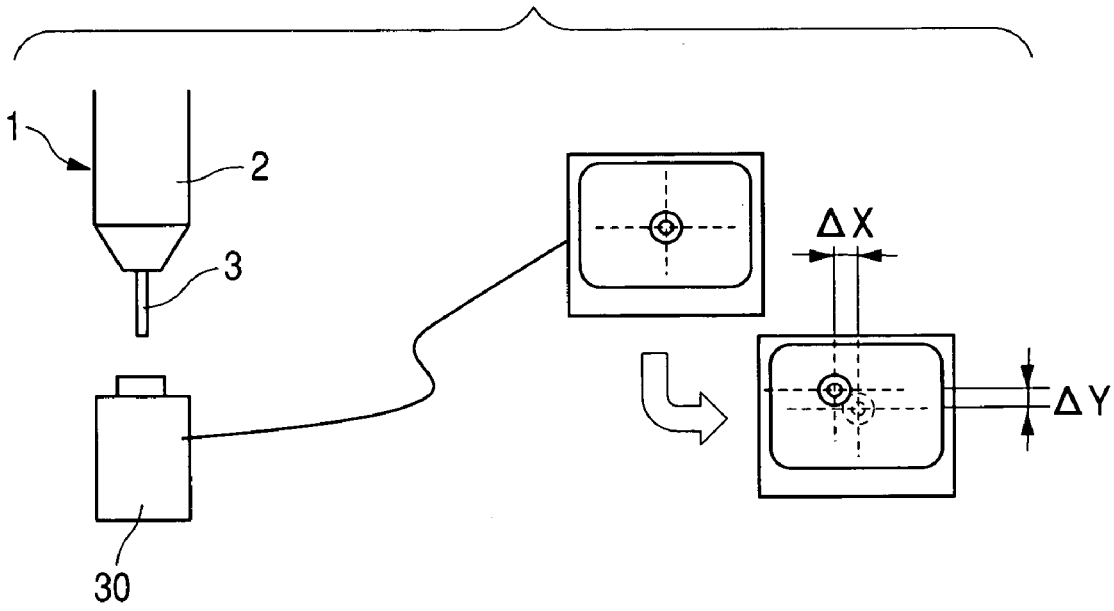
FIG. 4 is a schematic diagram showing the construction of a fourth embodiment of the present invention.

FIG. 4 shows a method of applying liquid material according to the fourth embodiment of the present invention, in which there is conducted needle bending detection through image recognition of the needle distal end surface for controlling the application position with high accuracy. In this case, the needle is imaged from below by an under-camera 30 facing the distal end surface of the needle for image recognition. After the new liquid material supply means 1 with the syringe 2 and the needle 3 has been set, the initial state of the needle 3 is imaged by the under-camera 30, and, when, in a first needle bottom surface image thus obtained through image taking, the needle distal end surface is out of focus and cannot be recognized due to bending of the needle 3 (bending attributable to operational error, etc.), it is determined that there is abnormality in the needle, and use thereof is prohibited. Even when the center of the needle distal end surface can be detected, its value is compared with pre-set information on the center of the needle distal end surface when there is no needle bending, and the comparison results (the deviation amount $\Delta X$ in the X-axis direction and the deviation amount $\Delta Y$ in the Y-axis direction) are not less than a certain value, it is determined that there is abnormality in the needle, and its use is prohibited.

Immediately after the setting of the liquid material supply means 1, even if there is no abnormality in needle bending, there is the possibility of needle bending being generated with passage of time (as it is repeatedly used). For this reason, also after repeated use of the needle 3, the distal end surface of the needle is imaged by the under-camera 30, and when, in the second needle bottom surface image thus obtained through image taking, the needle distal end surface is out of focus due to bending of the needle 3 (bending caused with passage of time) and cannot be recognized, it is determined that there is abnormality in the needle, and its use is prohibited. Even when the center of the needle distal end surface can be detected, its value is compared with pre-set information on the center of the needle distal end surface when there is no needle bending, and when the comparison results (the deviation amount in the X-axis direction and the deviation amount in the Y-axis direction) are not less than a certain value, it is determined that there is abnormality in the needle, and its use is prohibited.

In the fourth embodiment also, use of an excessively bent needle 3 is prohibited beforehand, whereby, when applying liquid material to the application surface of an object of application, it is possible to achieve an improvement in terms of accuracy in application position in the X- and Y-directions.

It is to be noted that the contact terminal of the contact type linear sensor of the first embodiment may be in the form of a needle so that it can be used in a narrow space.

Further, the checking on the needle distal end position in the first and second embodiments may be performed not only at the time of syringe replacement but also several times a day on the same syringe.

The above-described embodiments of the present invention should not be construed restrictively; it will be obvious to those skilled in the art that various modifications and variations are possible without departing from the scope of the appended claims.

As described above, in accordance with the present invention, it is possible to eject and apply liquid material to an object of application with high accuracy without being affected by misalignment, bending, and deflection of the needle caused at the time of replacement of the liquid material supply means including the syringe and the needle and as a result of repeated use of the needle.

What is claimed is:

1. A liquid material applying method, comprising:

using a liquid material supply means having a syringe containing the liquid material and equipped with a needle having at its distal end an ejection hole from which the liquid material is ejected; and applying a liquid material to an application surface of an object of application, said method comprising steps of taking an image of the distal end of the needle laterally by an image taking means together with a height reference mark when an ascent/descent drive system of the liquid material supply means is set to a reference height; and obtaining a height position of the distal end of the needle from a difference between the height of the distal end of the needle and a height of the height reference mark.

2. A liquid material applying method according to claim 1, further comprising:

measuring a height of the application surface by a height measuring means; and controlling a height of the liquid material supply means at a time of liquid material application based on a measurement value thereby obtained.

3. A liquid material applying method, comprising:

using a liquid material supply means having a syringe containing the liquid material and equipped with a needle having at its distal end an ejection hole from which the liquid material is ejected; and applying a liquid material to an application surface of an object of application, said method comprising steps of comparing a needle side surface reference image of a needle free from bending with a needle side surface image taken laterally by an image taking means in one of a state at the start of use of the needle and a state after repeated use thereof; and determining that there is abnormality in needle bending when a deviation amount between the needle side surface reference image and the needle side surface image thus taken exceeds a predetermined value.

4. A liquid material applying method according to claim 3, further comprising imaging the needle continuously or intermittently while rotating the needle at least by 90 degrees to thereby obtain the needle side surface image.

5. A liquid material applying method, comprising:

using a liquid material supply means having a syringe containing the liquid material and equipped with a needle having at its distal end an ejection hole from which the liquid material is ejected; and applying a liquid material to an application surface of an object of application, said method comprising steps of determining that there is abnormality in needle bending at one of a time when a needle distal end surface cannot be recognized in a first needle bottom surface image taken by an image taking means from a bottom surface direction in an initial state of the needle, and a time when a deviation amount between information on a center of the needle distal end surface in the first needle bottom surface image and pre-set information on the center of the needle distal end surface exceeds a predetermined value.

6. A liquid material applying method, comprising:

using a liquid material supply means having a syringe containing the liquid material and equipped with a needle having at its distal end an ejection hole from which the liquid material is ejected; and applying a liquid material to an application surface of an object of application, said method comprising steps of determining that there is abnormality in needle bending at one of a time when a needle distal end surface cannot be recognized in a second needle bottom surface image taken by an image taking means from a bottom surface direction after repeated use of the needle, and a time when a deviation amount between information on a center of the needle distal end surface in the second needle bottom surface image and pre-set information on the center of the needle distal end surface exceeds a predetermined value.

* * * * *